United States Patent [19]

Evans

[11] Patent Number: 4,513,704

[45] Date of Patent: Apr. 30, 1985

[54] PRESSURIZED LUBRICATION ASSEMBLY FOR MACHINERY HAVING A FLOW RESTRICTOR DEVICE

[76] Inventor: John W. Evans, Rte. 41, Sharon, Conn. 06069

[21] Appl. No.: 557,313

[22] Filed: Dec. 2, 1983

[51] Int. Cl.[3] ..... F01M 1/00; F02B 33/40

[52] U.S. Cl. ..... 123/196 S; 123/196 R; 60/605; 184/6.3

[58] Field of Search ..... 123/196 S, 196 R, 196 A, 123/196 M; 184/6.3, 6.4; 60/605

[56] References Cited

U.S. PATENT DOCUMENTS

| | | | |
|---|---|---|---|
| 2,736,307 | 2/1956 | Wilcox | 123/196 S |
| 2,755,787 | 7/1956 | Bulter et al. | 123/196 S |
| 2,889,821 | 6/1959 | Maki | 123/196 S |
| 3,045,420 | 11/1962 | Addie et al. | 60/605 |
| 3,057,432 | 10/1962 | Jacobson et al. | 123/196 A |
| 3,425,404 | 2/1969 | Lamkin | 123/196 S |
| 3,722,623 | 3/1973 | Waldecker | 123/196 S |
| 4,094,293 | 6/1978 | Evans | 128/196 M |
| 4,126,797 | 11/1978 | Henson | 60/605 |
| 4,331,112 | 5/1982 | Pluequet | 60/605 |
| 4,359,140 | 11/1982 | Shreve | 123/196 S |

*Primary Examiner*—E. Rollins Cross
*Attorney, Agent, or Firm*—Kenyon & Kenyon

[57] ABSTRACT

In an engine pressurized prelubricator assembly or an assembly for providing pressurized lubricant to the center bearing of an exhaust-driven turbocharger, flow restrictor means are disposed in the conduit connecting the engine lubricant system to the reservoir means for storing pressurized lubricant. The flow restrictor means restricts flow of lubricant into the reservoir means thereby preventing starving of the engine lubricant system for lubricant during charging of the reservoir means with lubricant. The flow restrictor means permits substantially unrestricted flow of lubricant from the reservoir means to the engine or center bearing when lubrication is required. A manually operated valve means is provided for use in the conduit connecting the engine lubricant system to the reservoir means. The rate of flow of lubricant through the valve and hence to and from the reservoir means is selectable by manually operating the valve. The rate of lubricant flow is manually selected responsive to the operating condition of the engine.

22 Claims, 8 Drawing Figures

10
11
12
13
14
15
16
17
18
55
55
TO ENGINE 10
13
18
20
21
22
24
25
26
27
28
A
B 55
11
14
10
12
55
13
18
61
63
60
TO CENTER BEARING 55
11
10
12
55
13
50
61
63
To Center Bearing
60

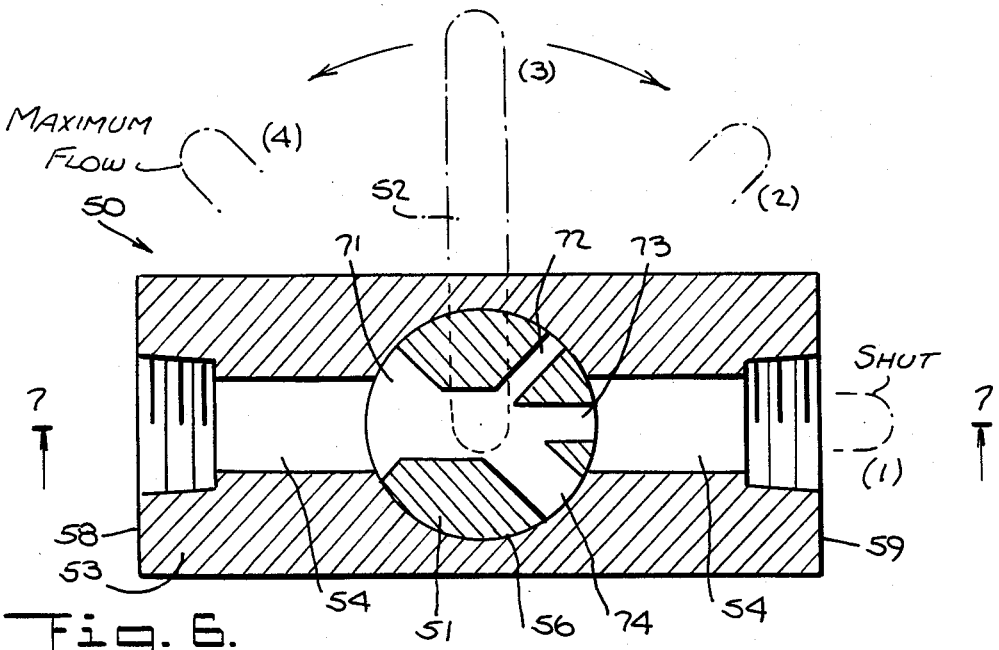
Fig. 6.
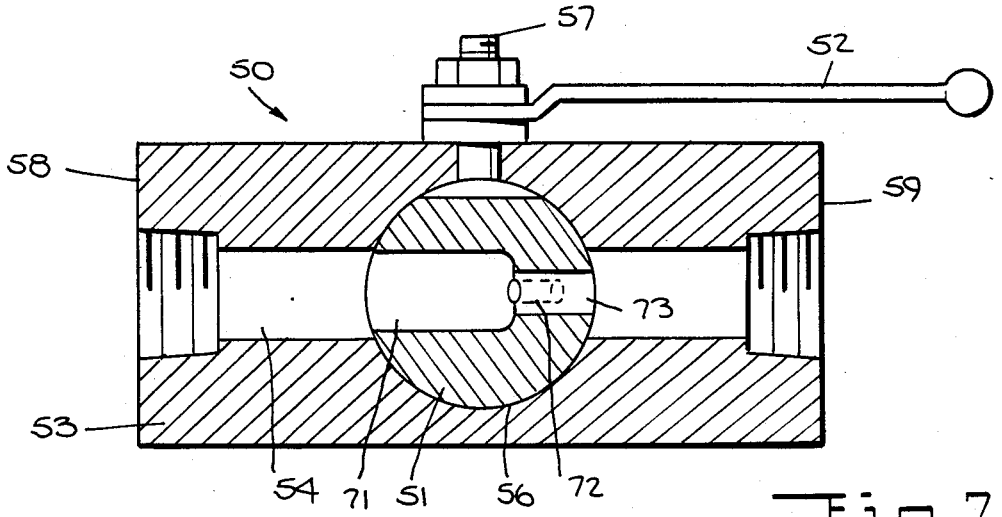
Fig. 7.
Fig. 8.
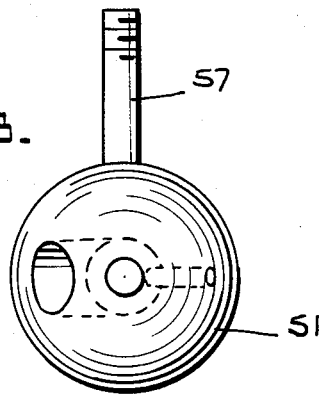

PRESSURIZED LUBRICATION ASSEMBLY FOR MACHINERY HAVING A FLOW RESTRICTOR DEVICE

FIELD OF THE INVENTION

This invention relates to pressurized prelubricator assemblies for machinery, such as internal combustion engines, and to pressurized lubrication assemblies for the center bearings of exhaust-driven turbochargers.

BACKGROUND OF THE INVENTION

The use of preoiling devices and oil reservoirs or accumulators of various designs in conjunction with internal combustion engines is generally well known. It has long been an acknowledged fact that a great deal of engine wear occurs as a result of "cold start scuffing," i.e., the starting of an engine after it has been idle for a period of time sufficient to allow its lubricating oil to drain into the engine's oil pan and crankcase, thus leaving many vital engine parts with no lubricant protection until the engine has been started and the oil pressure brought up to an acceptable level by the oil pump. Various preoiling devices have been designed, all having the purpose of providing oil pressure to the engine prior to start-up. An internal combustion engine preoiling device is discussed, e.g., in my U.S. Pat. No. 4,094,293 issued June 13, 1978.

My co-pending U.S. patent application Ser. No. 557,397 filed Dec. 2, 1983, which is a continuation-in-part of application Ser. No. 331,371 filed Dec. 16, 1981 entitled "Improved Engine Prelubricator and Pressurized Lubricant Reservoir" discloses that pressurized lubricant may be stored in a reservoir and be used to lubricate the center bearing of an exhaust-driven turbocharger after an engine is shut down.

Exhaust-driven turbochargers are themselves well known in the automotive arts. The idle speed of an exhaust-driven turbocharger often exceeds 30,000 rpm with top speeds of 90,000 to 120,000 rpm. When the automobile engine is operating, lubrication is supplied to the turbocharger's center bearing by the engine's lubrication system. When the engine shuts down, the flow of oil to the turbocharger center bearing essentially ceases. A time period of about 20 to 30 seconds can elapse between the time that the engine shuts down and the time at which the turbocharger stops turning. During this time period, the center bearing temperature can increase to as high as 1200° F. At such high temperatures, and because of the lack of oil flow, the small amount of oil remaining in the turbocharger center bearing carbonizes and ultimately the bearing will fail as a result of galling or seizure.

Engine prelubrication assemblies and exhaust-driven turbocharger center bearing post engine shut down lubrication systems have the following common feature. Lubricant is stored in a reservoir under pressure. When the machinery requires lubrication, the pressurized lubricant stored in the reservoir is used to lubricate the machinery. The source of pressurized lubricant stored under pressure in the reservoir of both such systems is the lubrication system of the internal combustion engine. That is, in both such systems the reservoir is charged with pressurized lubricant from the lubrication system of an internal combustion engine.

It will be appreciated, that when an engine is initially started up, it would be undesirable for the engine lubrication system to recharge the reservoir of these systems with pressurized lubricant from the engine lubrication system after a major volume of oil has been spent for pre-oiling. At engine start-up and during the build-up of lubricant pressure by the engine's lubricant pump, the engine lubricant system should be dedicated to providing lubricant to the engine parts and associated systems.

Recharging of the reservoir with lubricant from the engine lubrication system after initial engine start-up is not generally a problem if automatically actuated control valves are used to selectively control the flow of lubricant to and from the reservoir. An automatic solenoid actuated control valve for use with an engine prelubricator assembly is disclosed in my U.S. Pat. No. 4,094,293. An automatic solenoid actuated control valve for use with an exhaust-driven turbocharger center bearing post engine shut down lubrication system is disclosed in my co-pending U.S. patent application Ser. No. 557,321 filed Dec. 2, 1983 entitled "Pressurized Lubrication Assembly for the Center Bearing of a Turbocharger."

One may choose to use a manually operated control valve for controlling the flow of lubricant to and from the reservoir in either an engine prelubricator assembly or an exhaust-driven turbocharger center bearing post-engine shut down lubrication system. As disclosed in my aforementioned co-pending application entitled "Improved Engine Prelubricator and Pressurized Lubricant Reservoir" an exhaust-driven turbocharger center bearing post-engine shut down lubrication system may operate satisfactorily without any valve for controlling the flow of lubricant to and from the reservoir.

In either system, when an automatically controlled valve is not used for regulating the flow of lubricant from and to the reservoir, problems may arise from the recharging of the reservoir with lubricant at the time of initial engine start-up. These problems can arise from system design, inherently slow operator manual reaction time, and/or operator error.

There is also a need in the art for improved manually operated valves for use with engine prelubricator assemblies and exhaust-driven turbocharger post-engine shut down lubrication systems.

OBJECTS OF THE INVENTION

It is therefore an object of the present invention to provide an improved engine prelubricator and pressurized reservoir assembly having manually operated valve means for regulating the flow of lubricant to and from the reservoir and including means for restricting the charging of the reservoir with lubricant.

It is another object of the present invention to provide an improved exhaust-driven turbocharger center bearing post-engine shut down lubrication system having manually operated valve means for regulating the flow of lubricant to and from the reservoir and including means for restricting the charging of the reservoir with lubricant.

It is a further object of the present invention to provide an improved engine prelubricator and exhaust-driven turbocharger center bearing post-engine shut down lubrication system which does not have automatic or manual valve means for regulating the flow of lubricant to and from the reservoir but includes means for restricting the charging of the reservoir with lubricant.

It is yet another object of the present invention to provide improved manually operated valve means for regulating flow of lubricant to and from the reservoir of an engine prelubricator and pressurized reservoir assembly or to and from the reservoir of an exhaust-driven turbocharger center bearing post-engine shut down lubrication system.

These and other objects of the present invention will become apparent from the following description and claims in conjunction with the drawings.

SUMMARY OF THE INVENTION

One aspect of the present invention is directed to an improved prelubricator and pressurized reservoir assembly for lubricating machinery, such as an internal combustion engine, when the lubricant pressure falls below a specified level. A reservoir means for holding pressurized lubricant is coupled to the machinery by conduit means. Valve means are disposed in the conduit means for regulating flow of lubricant from the machinery to the reservoir and from the reservoir to the machinery.

A flow restrictor means is disposed in the conduit means, suitably between the valve means and the reservoir means. The flow resistor means has two operating positions. In the first operating position, the flow restrictor means provides for restricted lubricant flow from the machinery to the reservoir. The flow restrictor means may assume the first operating position directly responsive to the flow of lubricant from the machinery to the reservoir. That is, the flowing lubricant, itself, may directly cause the flow restrictor means to assume the first operating position.

In the second operating position, the flow restrictor means permits substantially unrestricted lubricant flow from the reservoir to the machinery. The flow restrictor means assumes the second operating position directly responsive to the flow of pressurized lubricant from the reservoir to the machinery. That is, the pressurized lubricant, itself, directly causes the flow resistor means to assume the second operating position.

The operating positions of the flow restrictor means are not manually set. The operating positions of the flow restrictor means are not automatically actuated by a device responsive to a signal generated by another device which senses lubricant flow or pressure.

A preferred flow restrictor means comprises a check valve-like member having a pivotally mounted gate. Tne gate has an aperture or orifice therein. In the first operating position, the gate is closed and restricted fluid flow is permitted from the machinery to the reservoir through the aperture positioned in the gate. In the second operating poistion, the gate is opened and thus permits substantially unrestricted fluid flow from the reservoir to the machinery.

The flow restrictor means of the present invention is advantageously employed when manually operated valve means are used to control lubricant flow between the reservoir and the machinery.

A principal advantage of the flow restrictor means, in accordance with the present invention, is that it prevents the machinery lubrication system from being starved for lubricant fluid when the reservoir is being charged with lubricant from the machinery lubrication system.

Another aspect of the present invention is directed to a manually operated valve means for regulating the flow of lubricant between the reservoir and the machinery. The manually operated valve, in accordance with the present invention, is suitably a ball type valve which may have three or more and preferably has four predetermined operating positions. In a first operating position, flow of lubricant between the machinery and the reservoir is prevented. In a second operating position, maximum or substantially unrestricted lubricant flow is permitted between the reservoir and the machinery. In a third operating position, restricted lubricant flow between the reservoir and the machinery is permitted. In a fourth operating position, restricted fluid flow between the reservoir and the machinery is permitted wherein for a given pressure and a given lubricant, the flow rate of the restricted fluid flow of the fourth operating position is greater than the flow rate of the restricted fluid flow of the third operating position but less than the flow rate of the maximum or substantially unrestricted fluid of the second operating position. The operating position of the valve means are set manually. In the preferred ball valve means of the invention, the operating positions are provided by a plurality of fluid passages in the ball-like member of the valve wherein the passages have different cross-sectional areas.

The flow restrictor means of the present invention is not required for use in combination with the improved manually operated valve of the present invention. However, they have a similar functional result. They both prevent starving the machinery for lubricant during charging of the reservoir when manually operated valves are used to regulate lubricant flow between the reservoir and the machinery.

In another aspect of the present invention, the flow restrictor means in accordance with the present invention may be advantageously employed with a pressurized lubrication assembly for the center bearing of an exhaust-driven turbocharger. The flow restrictor means of the present invention would be most advantageously employed in pressurized lubrication assemblies for turbocharger center bearings wherein a manually operated valve or no valve is used to regulate the flow of lubricant between the reservoir and the lubrication line for the center bearing.

The manually operated valve means, in accordance with the present invention, may also be advantageously used in a pressurized lubrication assembly for the center bearing of an exhaust-driven turbocharger to regulating the flow of lubricant between the reservoir and center bearing lubrication line.

BRIEF DESCRIPTION OF THE DRAWINGS

In the drawings forming part hereof

FIG. 6 is a cross-sectional top view of a preferred manually operated valve means in accordance with the present invention for use with the embodiments of the present invention illustrated in FIGS. 4 and 5;

FIG. 7 is a cross-sectional view along line 7—7 of FIG. 6; and

FIG. 8 is a perspective view of a preferred ball member used in the valve illustrated in FIGS. 7 and 8.

In the drawings, like part numbers indicate similar parts.

DESCRIPTION OF THE PREFERRED EMBODIMENTS

In order to provide a more complete understanding of the present invention and an appreciation of its advantages, a description of the preferred embodiments is presented in the following.

Figures 1, 3:
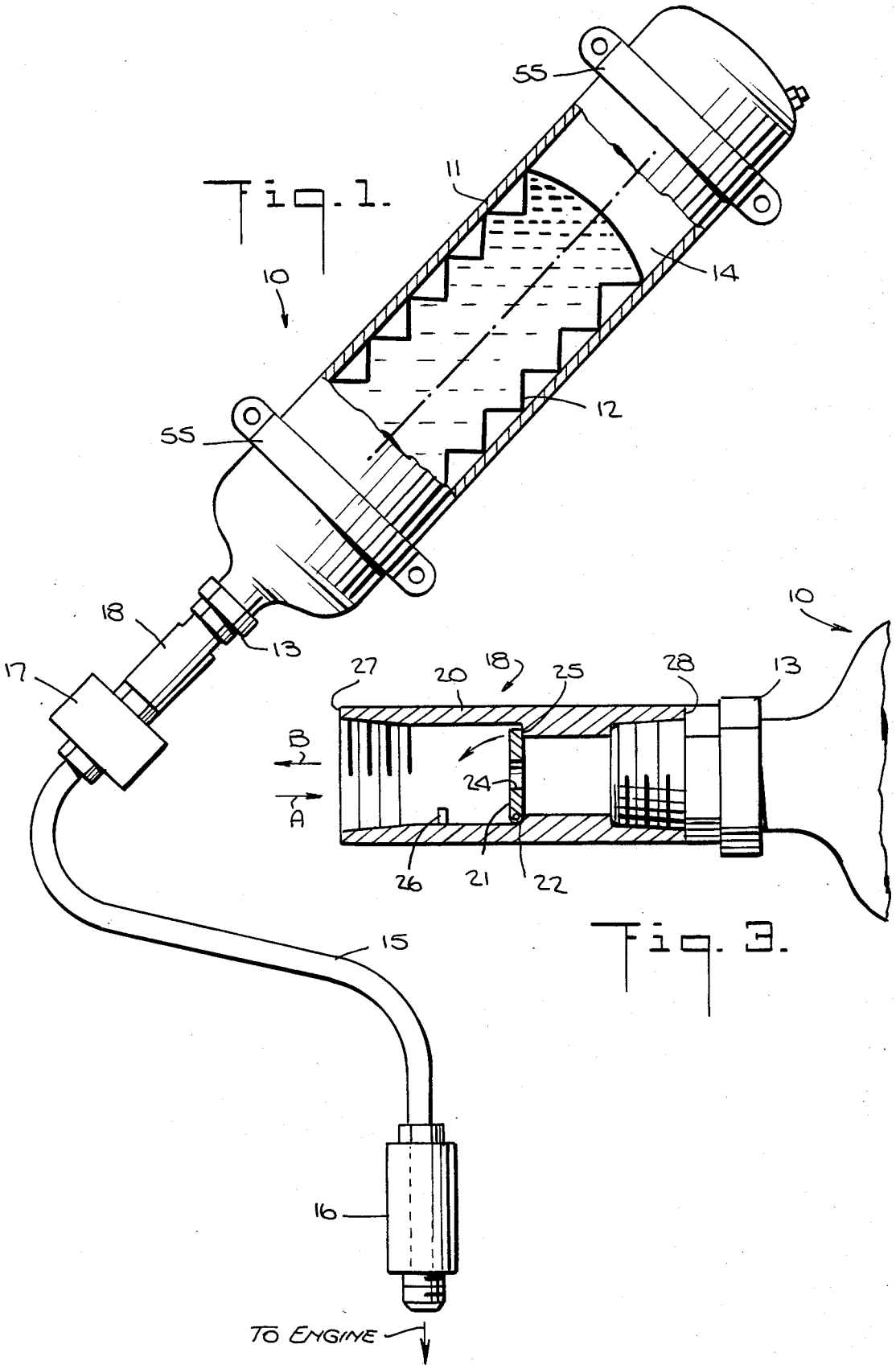
FIG. 1 schematically illustrates, with some parts broken away, a prelubricator and pressurized lubricant reservoir assembly for use with machinery, such as an internal combustion engine, having a flow restrictor means in accordance with one embodiment of the present invention.
FIG. 3 is a schematic cross-sectional view of a preferred flow restrictor means of the present invention for use with the embodiments of the present invention illustrated in FIGS. 1 and 2.

FIG. 1 schematically illustrates a prelubricator and pressurized lubricant reservoir assembly in accordance with one embodiment of the present invention. A reservoir means 10 for storing a quantity of pressurized lubricant is coupled by a fluid conduit 15 to the lubrication system of an internal combustion engine (not illustrated). Coupling 16 would be used to join conduit 15 to the engine lubrication system. Reservoir means 10 comprises an elongated cylindrical shaped cylinder 11 which may be mounted to the engine compartment or vehicle frame by, e.g., straps 55.

Fluid conduit 15 includes a manually operated valve 17 which is opened to permit fluid flow between the reservoir means 10 and the internal combustion engine and closed to prevent fluid flow between the reservoir means 10 and the internal combustion engine. The manually operated valve 17 may have a variety of constructions. For example, it could be a simple conventional valve. It could take the form of the multi-chambered diaphragm valve disclosed in my aforementioned U.S. Pat. No. 4,094,293 wherein the valve plunger is manually actuated being a full on or full off type rather than being solenoid controlled responsive to signals generated by changes in system lubricant pressure. The details of the construction of the manually operated valve 17 are not important with respect to this aspect of the invention.

In accordance with the present invention, a flow restrictor means 18 is disposed in fluid conduit 15. In the illustrated embodiment, flow restrictor means 18 is positioned between valve 17 and the reservoir means 10. It will be appreciated that flow restrictor means 18 could be positioned in fluid conduit means 15 between valve 17 and coupling 16. In a suitable arrangement, such as illustrated in FIG. 1, flow restrictor means 18 is joined to bushing or fluid passage 13 of reservoir means 10 and valve 17 is joined to flow restrictor means 18.

Flow restrictor means 18 assumes a first operating position which may be assumed directly responsive to lubricant flow from the internal combustion engine to the reservoir means 10. In this first operating position, the flow restrictor means 18 provides for restricted fluid flow from the internal combustion engine lubricant system to the reservoir means 10.

Flow restrictor means 18 assumes a second operating position directly responsive to lubricant flow from the reservoir means 10 to the internal combustion engine. In this second operating position, the flow restrictor means 18 provides for substantially unrestricted fluid flow from the reservoir means 10 to the internal combustion engine.

A preferred flow restrictor means 18 for use in accordance with the present invention is illustrated in FIG. 3. With reference to FIG. 3, flow restrictor means 18 comprises an elongated generally cylindrical body or casing 20 having a fluid passage extending longitudinally therethrough. Gate or flapper 21 is pivotally mounted within the fluid passage of the flow restrictor means by hinge mounting 22. Gate 21 has an orifice or aperture 24 therein. In FIG. 3, gate 21 is illustrated in a closed position resting against a shoulder 25 formed in casing 20 of the flow restrictor means 18. In the open position, gate 21 would rest against stantion pin 26 projecting from the interior wall of casing 20. Ends 27 and 28 of flow restrictor 18 are threaded in the illustrated embodiment for connection to fluid conduit means 15 and bushing or fluid passage 13 of reservoir means 10.

It will be appreciated that flow restrictor means 18, as illustrated in FIG. 3, would operate as follows. If lubricant is flowing in the direction of arrow A [i.e., from the engine to the reservoir means 10], the flow of the lubricant would force gate or flapper 21 off pin 26 and into contact with shoulder 25. Lubricant flow would continue through aperture 24 to reservoir 10. However, this lubricant flow to reservoir 10 would be a restricted fluid flow. If lubricant is flowing in the direction of arrow B [i.e., from the reservoir means 10 to the engine], the flow of the lubricant will force gate or flapper 21 to open. That is, gate or flapper 21 will pivot on hinge 22 and come to rest against pin 26.

An alternative construction for flow resistor means 18 would be to provide a spring [not illustrated] which urges the gate or flapper 21 into the closed position against shoulder 25. In this embodiment, pin 26 could be eliminated. Flow of lubricant in the direction of arrow A would assist in closing the gate or flapper 21. Opening gate or flapper 21 would still be accomplished by the flow of lubricant in the direction of arrow B acting against the force of the spring which urges gate or flapper 21 into the closed position.

One skilled in the art will appreciate that lubricant will flow in the direction of arrow A when the pressure of the lubricant stored in reservoir means 10 is less than the pressure of the lubricant in the engine lubricant system. Lubricant will flow in the direction of arrow B when the pressure of lubricant stored in the reservoir 10 is greater than the pressure of the lubricant in the engine lubricant system.

It will be appreciated that one skilled in the art will be able to design other types of flow restrictor means in accordance with the principles of the present invention. For example, a piston type assembly which opens and closes in response to fluid flow could be devised with a bore or passage drilled in the center of the piston for providing restricted flow in closed position. A ball type assembly with radial slots in the sealing surface for providing the restricted flow in the closed position could be provided.

In operation, the assembly of the present invention would function as follows. Prior to engine start-up, bellows 12 of reservoir means 10 would be filled with pressurized lubricant. Compressed air would be located on the air side 14 of bellows 12. Bellows 12 is in fluid communication with fluid passage 13 of reservoir means 10. At engine start-up, valve 17 would be opened and the compressed air in reservoir 10 will then force lubricant out of the reservoir 10 by contracting the bellows 12. Lubricant flow through flow restrictor means 18 will open gate or flapper 21. The lubricant continues to flow through valve 17, conduit 15 and on into the internal combustion engine.

Subsequent to pre-oiling and immediately after discharge of the reservoir 10 to the initially started engine, the oil pump builds oil pressure in the engine, and lubricant flows from the engine oil system through conduit means 15, open valve 17 and through flow restrictor means 18. The flow of lubricant closes gate or flapper 21. Restricted flow of lubricant continues to flow through orifice or aperture 24 and into the bellows 12 of the reservoir 10. The bellows 12 begins to expand as it fills with lubricant and compresses air within the container 11 on the air side 14 of the bellows. Pressurized lubricant is being stored in the reservoir means 10 for future use. After the reservoir means 10 has been charged with pressurized lubricant, and at least prior to engine shut down, valve 17 will be closed. Pressurized lubricant is stored in the reservoir means 10 and is available for a subsequent engine start-up.

It will be appreciated that flow restrictor means 18 by providing for a restricted fluid flow to the reservoir means 10 when it is being charged with lubricant prevents the engine oil system from being starved for lubricant which could occur during charging of the reservoir means 10. However, unrestricted fluid flow is provided for lubricating the engine at engine start-up when the engine requires a rapid injection of lubricant. The feature of providing for restricted flow for charging the reservoir means 10 is particularly important if valve 17 remains open during the period of initial engine start-up after lubricant has been discharged from the reservoir means 10 into the engine. Immediately after engine start-up, the lubricant pressure provided by the engine oil pump will be low and it would not be desirable for large amounts of lubricant to be drained from the lubricant system for charging the reservoir. The flow restrictor 18 of the invention, by restricting flow of lubricant from the engine to the reservoir, resolves this problem.

The flow restrictor in accordance with the present invention is particularly intended for use when valve 17 is a manually operated valve. This is because the operator may forget or react slowly in closing valve 17 after discharge of reservoir means 10 at engine start-up. In addition, in some instances, an operator may not desire to have to perform this manual function at the time of initial start-up. Additionally, the flow restrictor would also protect the engine during reservoir recharging periods encountered by running conditions such as pressure drops due to oil pan surges caused by cornering or braking. These conditions are common to high performance and off road vehicles.

If desired, the flow restrictor, in accordance with the invention, could be used with automatically controlled valves 17 such as a solenoid controlled valve.

Details of the operation of a prelubricator and pressurized lubricant assembly may be found in my U.S. Pat. No. 4,094,293 the disclosure of which is expressly incorporated herein by reference. Details of the operation of a bellows type reservoir in a prelubricator and pressurized lubricant assembly may be found in my co-pending U.S. patent application Ser. No. 557,470 filed Dec. 2, 1983 which is entitled "Improved Machinery Prelubricator Device Having A Bellows Type Reservoir Assembly" and the disclosure of which is expressly incorporated by reference herein. Use of the bellows type reservoir assembly is not required for the practice of the invention. Many types of reservoirs for storing lubricant under pressure may be used. For example, a piston type reservoir such as disclosed in my U.S. Pat. No. 4,094,293 may be used. A hollow type reservoir such as disclosed in my aforementioned co-pending application entitled "Improved Engine Prelubricator and Pressurized Lubricant Reservoir" may be used.

In many instances, the internal diameter of the fluid passage of flow restrictor means 18 would be selected to be approximately equal to the internal diameter of the fluid passage of fluid conduit means 15. This, however, is not a requirement for practice of the present invention.

By way of example, the size of the aperture located in gate or flapper 21 may be selected so that for a given lubricant under given pressure and temperature conditions, the restricted flow rate of lubricant from the engine to the reservoir means 10 would be about 30% to 40% the substantially unrestricted flow rate of lubricant from the reservoir means to the engine. It will be appreciated that the restricted lubricant flow rate from the engine to the reservoir means will be further reduced during the time period immediately following engine start-up when the lubricant pressure in the engine lubricant system is low. Witn flow restrictor 18 having a fluid passage with an internal diameter of $\frac{5}{8}$ inches, apertures in gate 21 having a diameter of $\frac{1}{4}$ inches may be used for engines having a nominal lubricant system operating pressure of about 70 psig at a flow rate of 3 to 5 gpm and with reservoirs having a capacity of about 2 quarts of lubricant.

Figure 2:
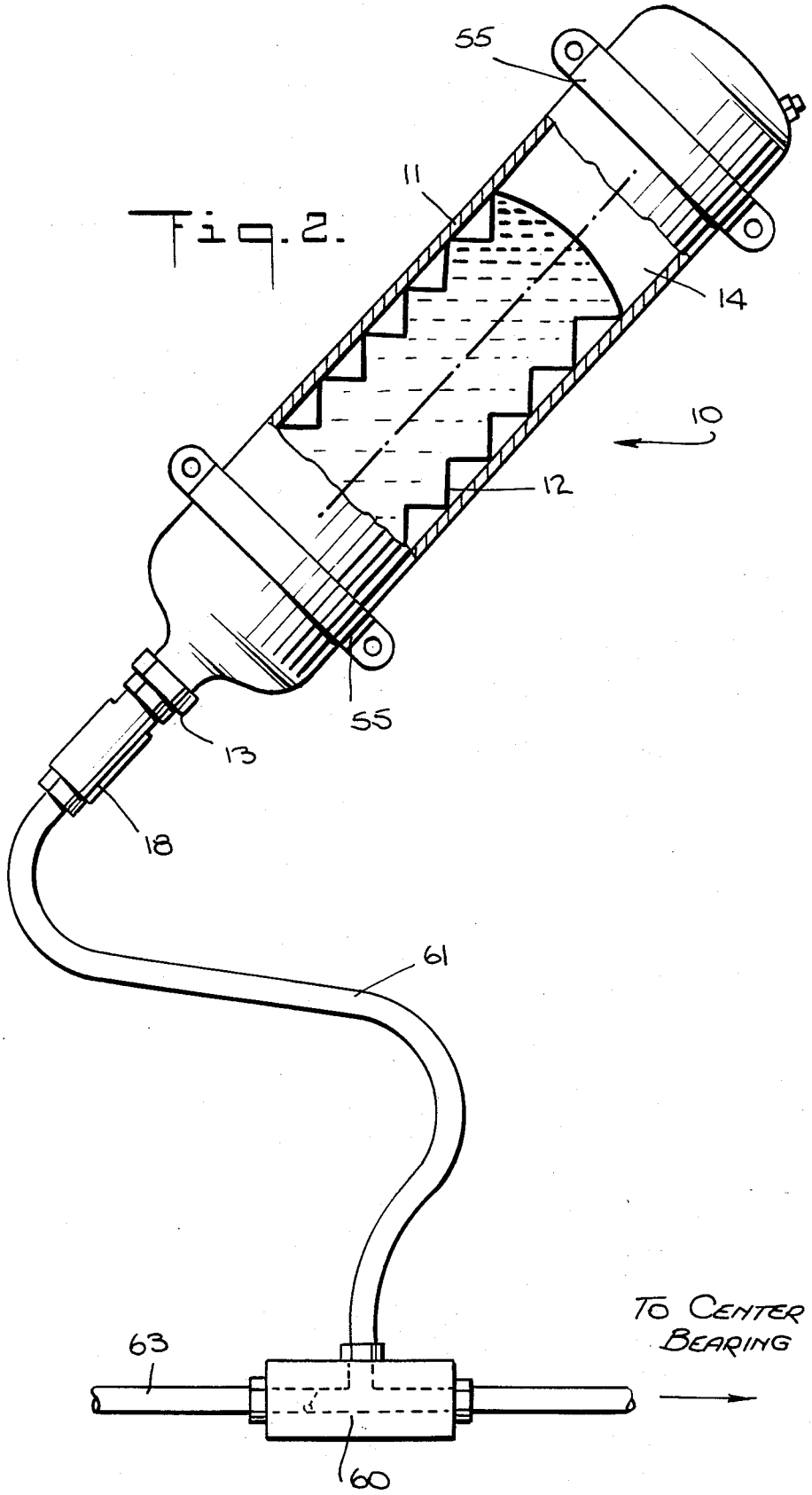
FIG. 2 schematically illustrates, with some parts broken away, a pressurized lubrication assembly for a center bearing of an exhaust-driven turbocharger having a flow restrictor means in accordance with another embodiment of the present invention.

FIG. 2 illustrates another embodiment of the present invention wherein a flow restrictor means 18 is employed with a pressurized lubricant assembly for providing lubrication to the center bearing of an exhaust-driven turbocharger after engine shut down. For details of the general operation of such an assembly, one may refer to my aforementioned co-pending application entitled "Improved Engine Prelubricator and Pressurized Lubricant Reservoir" and my co-pending U.S. patent application Ser. No. 557,321 filed Dec. 2, 1983 entitled "Pressurized Lubrication Assembly For The Center Bearing Of A Turbocharger" the disclosures of both of which are expressly incorporated by reference herein.

Operation of the embodiment of the present invention illustrated in FIG. 2 would be as follows. First fluid conduit means 63 is connected to an engine lubricant system [not illustrated] and to the center bearing of an exhaust-driven turbocharger [not illustrated]. When the engine is operating, pressurized lubricant is provided to the center bearing via conduit 63 from the engine lubricant system. Reservoir means 10 is connected in fluid communication with first fluid conduit means 63 and hence to the center bearing via second fluid conduit means 61 which is coupled to first fluid conduit means 63 by T-type check valve 60. Check valve 60 permits lubricant flow from the engine lubricant system to both the center bearing and the reservoir means 10. However, check valve 60 directs lubricant flow from the reservoir means 10 directly to the center bearing. Check valve 60 does not permit lubricant flow from reservoir means 10 directly to the engine lubricant system.

Flow restrictor means 18 is disposed in second fluid conduit means 61. In the illustrated embodiment, flow restrictor means 18 is coupled directly to fluid passage or bushing 13 of reservoir means 10. An advantageous flow restrictor means 18 for use in the embodiment of FIG. 2 would be that illustrated in FIG. 3.

At engine start-up, reservoir means 10 would be substantially empty. That is, the lubricant stored in reservoir means 10 would be substantially depleted. The operating engine would provide pressurized lubricant in fluid conduit 63. This pressurized lubricant would flow to the center bearing and to the reservoir means 10 via fluid conduit 61. Flow restrictor means 18 would result in a restricted fluid flow to the reservoir means 10 thus avoiding a starving of the lubricant system when the reservoir means 10 is being charged with lubricant. During the operating period of the engine, reservoir means 10 would become charged with pressurized lubricant. At engine shut down, the engine lubricant system would cease to provide lubricant to the turbocharger center bearing during the turbocharger spin down. The pressurized lubricant is discharged from reservoir means 10 to provide the center bearing with pressurized lubricant during the turbocharger spin down after engine shut down. Flow restrictor means 18 operates to permit a substantially unrestricted lubricant flow from the reservoir means 10 through second conduit means 61 and subsequently to the center bearing.

If desired, a manually operated valve means [not illustrated] could be disposed in second fluid conduit means 61 and the flow restrictor means 18 could be used to advantage in combination with the manually operated valve means. The manually operated valve would be closed at initial engine start-up when lubricant pressure is low. The manually operated valve would be opened when the engine lubricant system pressure had built up in order to provide for charging of the reservoir means 10 with pressurized lubricant. The manually operated valve means would also be in an open position at engine shut down so that the reservoir means 10 can discharge in order to provide pressurized lubricant for the center bearing of the turbocharger during spin down. It will be appreciated that flow restrictor means 18 may be positioned in conduit means 61 between the manually operated valve means and the reservoir means 10 or between the manually operated valve means and the check valve 60.

Flow restrictor means 18 may be employed with a post-engine shut down lubrication system for use with the center bearing of a turbocharger which employs an automatically controlled valve such as a solenoid controlled valve for regulating flow of lubricant as disclosed in my aforementioned co-pending application entitled "Pressurized Lubrication Assembly For The Center Bearing Of A Turbocharger." However, flow restrictor means 18 is most advantageously employed when either no regulating valve is used in fluid conduit 61 or a manually operated regulating valve is employed in fluid conduit 61.

An improved manually operated valve for regulating flow of lubricant from and to a pressurized lubricant reservoir is illustrated in FIGS. 4 to 8 of the drawings. In accordance with this embodiment of the present invention, the manually operated valve 50 provides a plurality of lubricant flow refill rates for the reservoir means 10 that may be manually selected.

Figure 4:
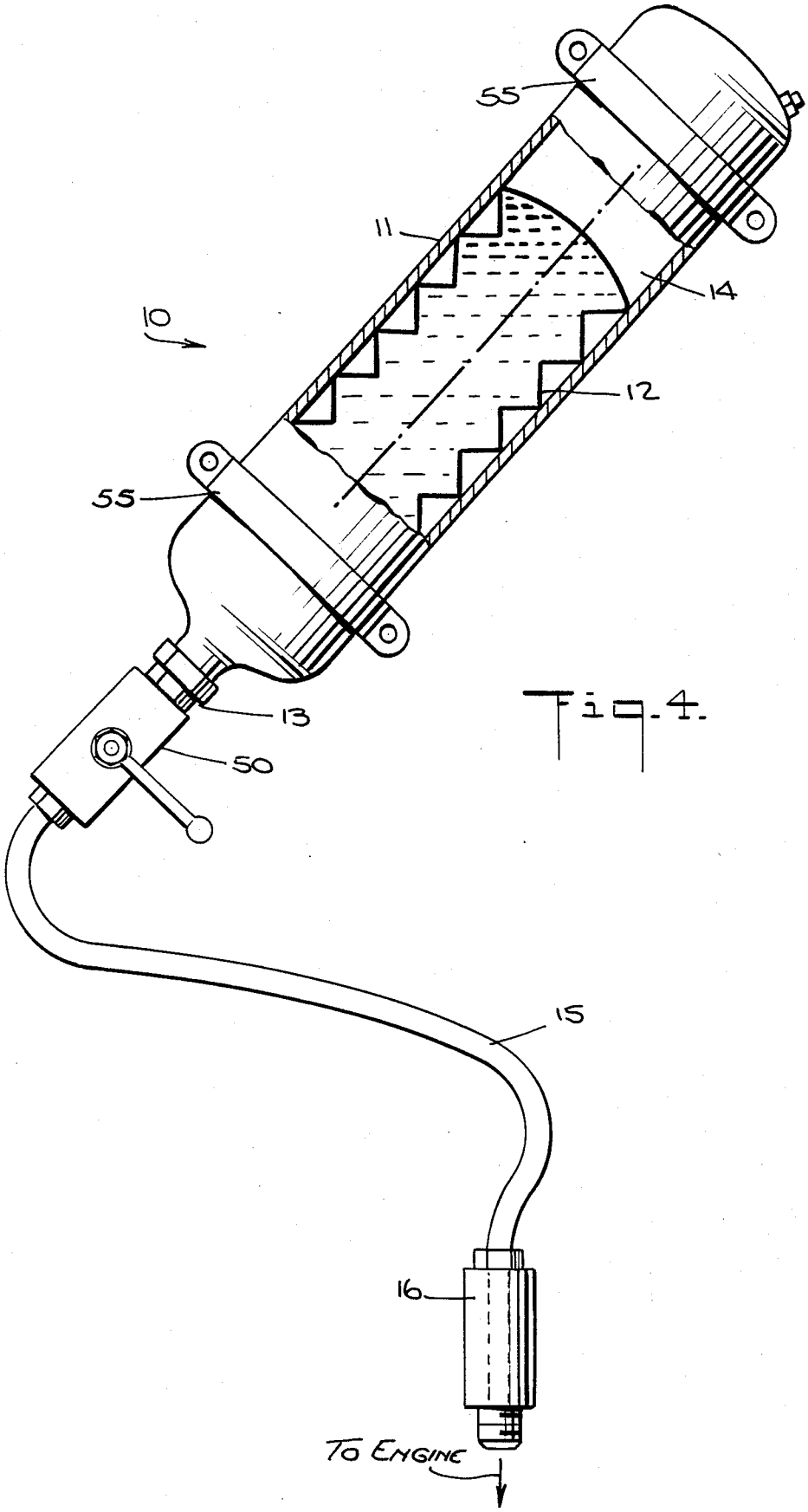
FIG. 4 schematically illustrates, with some parts broken away, a prelubricator and pressurized lubricant reservoir assembly for use with machinery, such as an internal combustion engine, having an improved manually operated valve means in accordance with another embodiment of the present invention.

In FIG. 4, manually operated valve 50 is illustrated disposed in fluid conduit means 15 of a prelubricator and pressurized lubricant system for providing prelubrication for an internal combustion engine. In the embodiment illustrated in FIG. 4, valve 50 is connected to fluid passage or bushing 13 of reservoir means 10.

Figure 5:
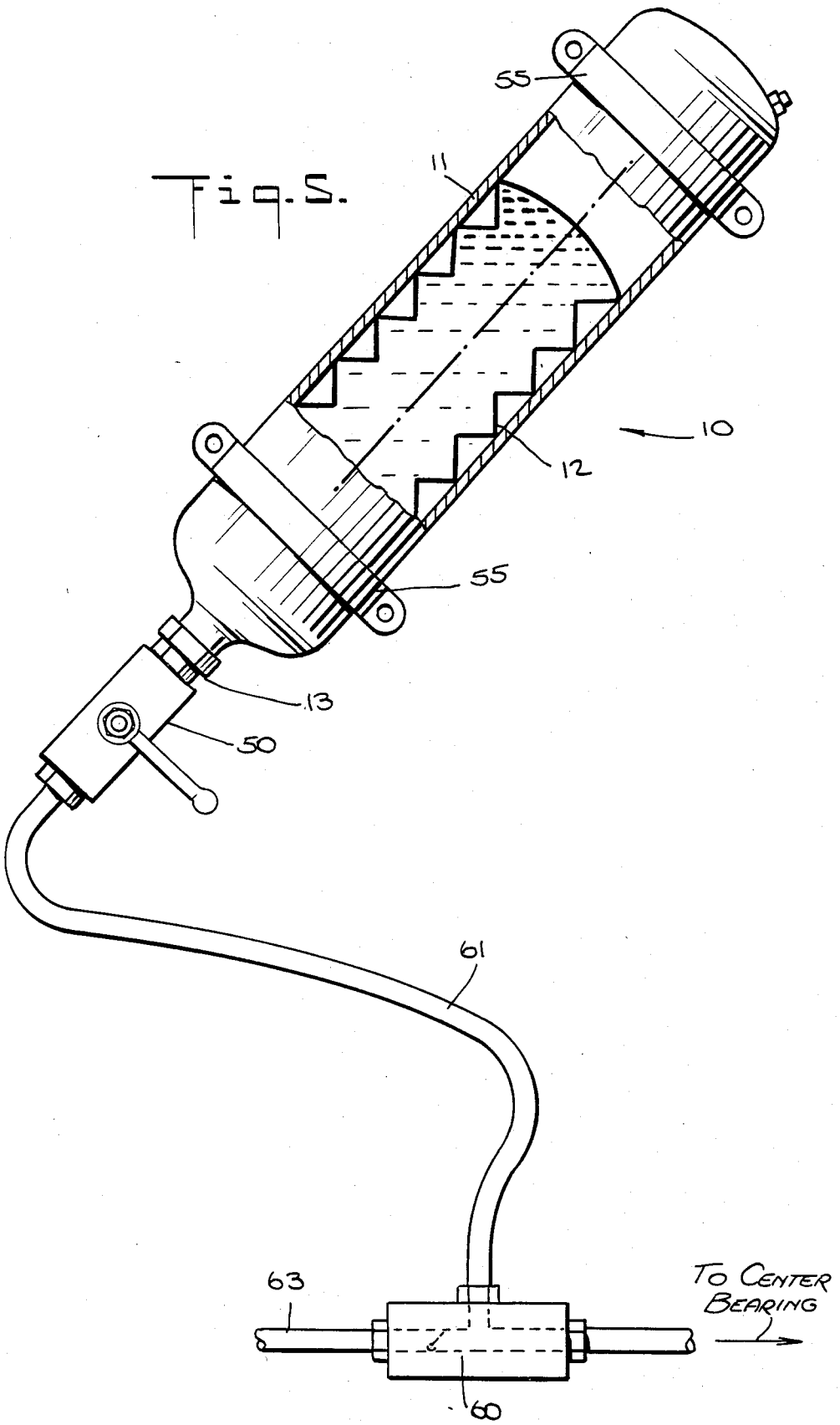
FIG. 5 schematically illustrates, with some parts broken away, a pressurized lubrication assembly for a center bearing of an exhaust-driven turbocharger having an improved manually operated valve means in accordance with another embodiment of the present invention.

In FIG. 5, manually operated valve 50 is illustrated disposed in second fluid conduit means 61 of a pressurized lubrication assembly for a center bearing of an exhaust-driven turbocharger. In the embodiment illustrated in FIG. 5, valve 50 is again connected to fluid passage or bushing 13 of reservoir means 10.

FIGS. 6 to 8 illustrate a preferred manually actuated valve 50 in accordance with the present invention. In this illustrated embodiment, four operating positions may be manually selected by turning ball member 51 of valve 50 by handle member 52.

Valve 50 comprises a housing 53 having a fluid passage 54 therethrough. A cavity 56 is located in housing 53 within fluid passage 54. Ball member 51 is disposed in cavity 56 of housing 53 for controlling fluid flow through fluid passage 54. Ball member 51 has a stem 57 projecting therefrom. Stem 57 penetrates housing 53. Handle member 52 is connected to stem 57 whereby handle 52 may be used to turn ball member 51 within cavity 56 of housing 53. First end 58 of housing 53 and second end 59 of housing 53 are provided with threaded apertures respectively for connection to the reservoir means 10 and conduits 15, 61 in the illustrated embodiments.

Located within ball member 51 are a first fluid passage 71, a second fluid passage 72, a third fluid passage 73, and a fourth fluid passage 74. Second fluid passage 72, third fluid passage 73, and fourth fluid passage 74 each individually communicate with first fluid passage 71.

It will now be appreciated that valve means 50 provides for four manually selectable predetermined flow conditions. In position 1, the solid wall of ball 51 will be adjacent fluid passage 54 of housing 53 and fluid flow through valve 50 will be prevented. In position 4, first fluid passage 71 and fourth fluid passage 74 will be in communication with fluid passage 54 of housing 53. Since fluid passage 74 is a larger passage, maximum or substantially unrestricted fluid flow will be permitted through valve 50. It will be appreciated that the internal diameter of fluid passage 74 could be approximately the same as the internal diameter of fluid passage 54 of valve 50 and the internal diameter of associated lubricant conduits of the system.

In position 3, first fluid passage 71 and third fluid passage 73 are in communication with the fluid passage 54 of valve 50. This configuration is illustrated in FIG. 6. The fluid flow rate permitted by passage 73 for a given pressure, temperature and lubricant is less than maximum or substantially unrestricted flow permitted by fluid passage 74 but greater than that permitted by fluid passage 72. That is, the inside diameter of fluid passage 73 is less than the inside diameter of fluid passage 74 but greater than the inside diameter of fluid passage 72. Lubricant flow through fluid passage 73 may be said to be restricted.

In position 2, first fluid passage 71 and second fluid passage 72 are in fluid communication with fluid passage 54 of valve 50. The fluid flow rate permitted by passage 72 for a given pressure, temperature and lubricant is less than that permitted by fluid passage 73.

Lubricant flow through fluid passage 72 may be said to be most restricted or greatly restricted.

Examples of useful lubricant flow rates which may be provided for a given lubricant at a given pressure and temperature are as follows: Maximum or substantially unrestricted flow through fluid passage 74; about 50% of maximum through fluid passage 73; and about 20% of maximum through fluid passage 72. In many instances, maximum or substantially unrestricted flow through passage 74 would be approximately the flow permitted by fluid conduit 15, 61 for a given pressure. The percentages given are by way of example. Flow permitted through fluid passage 73 could be selected to be between, e.g., about 40% to 60% of maximum. Flow permitted through fluid passage 72 could be selected to be between, e.g., about 15% to 25% of maximum. One skilled in the art could select the desired restricted flow rates depending on the service application.

It will be apparent that a valve could be provided having three selected positions, i.e., shut, one restricted flow position, and a maximum or substantially unrestricted flow position. Likewise, more than two restricted fluid flow positions permitting multiple different restricted fluid flow rates could be provided for.

Operation of the valve 50 in conjunction with the engine prelubrication and pressurized lubricant assembly illustrated in FIG. 4 will now be described. Immediately prior to engine start-up, the valve would be placed in position 4 permitting substantially unrestricted or maximum flow of lubricant from the reservoir to the engine. After preoiling discharge of the reservoir at the period of engine start-up, the valve 50 would be placed in position 2 which provides for only very restricted fluid flow from the engine lubricant system to the reservoir means 10. As engine lubricant pressure begins to build up as well as the pressure of lubricant within the reservoir means 10, the valve 50 is moved to position 3 which permits a greater rate of restricted fluid flow of lubricant into the reservoir. Once an equilibrium is achieved between the engine lubricant system and the reservoir, the valve 50 would be moved to position 4 or maximum flow to provide for fully charging the reservoir means 10 with pressurized lubricant. Prior to engine shut down, the valve 50 would be moved to position 1 whereby lubricant flow through the valve 50 is prevented. Pressurized lubricant is thus stored in the reservoir means 10 for the next engine start-up.

For the turbocharger center bearing embodiment of FIG. 5, valve means 50 could be operated in a similar manner for charging of the reservoir means 10 with lubricant. The valve 50 would be set at the maximum flow position at engine shut down in order to provide maximum flow of lubricant to the center bearing during the turbocharger spin down after the engine is shut off.

In general, flow restrictor means 18 of the present invention would not have to be used when manual valve means 50 of the present invention is used.

In the foregoing specification, the invention has been described with reference to specific example embodiments thereof. It will, however, be evident that various modifications and changes may be made thereunto without departing from the broader spirit and scope of the invention as set forth in the appended claims. The specification and drawings are, accordingly, to be regarding in an illustrative rather than in a restrictive sense.

What is claimed is:

1. An improved prelubricator and pressurized lubricant reservoir assembly for lubricating machinery, such as an internal combustion engine, when the lubricant pressure in the machinery is below a specified level said assembly comprising:

reservoir means for storing a quantity of lubricant under pressure;

conduit means for coupling said reservoir means and said machinery in fluid communication whereby lubricant flows in said conduit means in a first direction from said machinery to said reservoir means and in a second direction from said reservoir means to said machinery;

valve means disposed in said conduit means for selectively permitting and preventing flow of lubricant in said conduit means;

flow restrictor means disposed in said conduit means, said flow restrictor means having a first operating position for providing for restricted lubricant flow in said first direction and a second operating position for providing for substantially unrestricted lubricant flow in said second direction; and wherein said flow restrictor means comprises:

a casing having a fluid passage therethrough; and a gate having an aperture therein pivotally mounted within said fluid passage wherein said gate assumes a closed position when said lubricant flows in said first direction whereby restricted lubricant flow from said machinery to said reservoir means through said aperture is permitted and wherein lubricant flow in said second direction opens said gate whereby substantially unrestricted lubricant flow from said reservoir means to said machinery is permitted by said open gate.

2. An assembly as recited in claim 1 wherein said second operating position of said flow restrictor means is assumed directly responsive to lubricant flow in said second direction.

3. An assembly as recited in claim 2 wherein said first operating position of said flow restrictor means is assumed directly responsive to lubricant flow in said first direction.

4. An assembly as recited in claim 1 wherein said valve means is manually operated.

5. An assembly as recited in claim 1 wherein said gate assumes said closed position directly responsive to lubricant flow in said first direction.

6. A pressurized lubrication assembly for a center bearing of an exhaust-driven turbocharger associated with an internal combustion engine wherein said engine includes means for providing flow of pressurized lubricant through first conduit means to said turbocharger when said engine is running, said lubrication assembly comprising:

reservoir means for storing a quantity of lubricant under pressure;

second conduit means coupled to said reservoir means and said first conduit means for permitting flow of lubricant in a first direction from said first conduit means to said reservoir means and in a second direction from said reservoir means to said first conduit means and thereby to said turbocharger;

flow restrictor means permitting continuous fluid flow therethrough disposed in said second conduit means intermediate said reservoir means and the coupling of said second conduit means with said first conduit means, said flow restrictor means having a first operating position for providing for restricted lubricant flow in said first direction and a second operating position for providing for substantially unrestricted lubricant flow in said second direction and thereby to said turbocharger.

7. An assembly as recited in claim 6 wherein said second operating position of said flow restrictor means is assumed directly responsive to lubricant flow in said second direction.

8. An assembly as recited in claim 7 wherein said first operating position of said flow restrictor means is assumed directly responsive to lubricant flow in said first direction.

9. An assembly as recited in claim 6 wherein said flow restrictor means comprises:

a casing having a fluid passage therethrough; and a gate having an aperture therein pivotally mounted within said fluid passage wherein said gate assumes a closed position when said lubricant flows in said first direction whereby restricted lubricant flow from said first conduit means to said reservoir means through said aperture is permitted and wherein lubricant flow in said second direction opens said gate whereby substantially unrestricted lubricant flow from said reservoir means to said first conduit means and thereby to said turbocharger center bearing is permitted by said open gate.

10. An assembly as recited in claim 9 wherein said gate assumes said closed position directly responsive to lubricant flow in said first direction.

11. An assembly as recited in claim 6 wherein said second conduit means further includes valve means disposed therein for selectively permitting and preventing flow of lubricant in said second conduit means.

12. An assembly as recited in claim 11 wherein said valve means is located intermediate said flow restrictor means and the coupling of said second conduit means to said first conduit means.

13. An assembly as recited in claim 11 wherein said valve means is a manually operated valve.

14. An improved prelubricator and pressurized lubricant reservoir assembly for lubricating machinery, such as an internal combustion engine, when the lubricant pressure in the machinery is below a specified level, said assembly comprising:

reservoir means for storing a quantity of lubricant under pressure;

conduit means for coupling said reservoir means and said machinery in fluid communication whereby lubricant flows in said conduit means in a first direction from said machinery to said reservoir means and in a second direction from said reservoir means to said machinery;

manually operated valve means disposed in said conduit means, said valve means being constructed to have at least three manually actuated selective predetermined operating positions; wherein:

a first predetermined operating position substantially prevents lubricant flow in said conduit means;

a second predetermined operating position permits maximum lubricant flow in said conduit means; and a third predetermined operating position permits restricted lubricant flow in said conduit means.

15. An assembly as recited in claim 14 wherein said manually operated valve means has a fourth selective predetermined operating position permitting lubricant flow in said conduit means wherein at a given pressure the restricted lubricant flow rate in said fourth selective position is greater than the restricted lubricant flow rate in said third selective position but less than the maximum lubricant flow rate of said second selective position.

16. An assembly as recited in claim 14 wherein said manually operated valve means comprises a ball valve having a rotatable ball-like member wherein said ball-like member has a plurality of fluid passages of different cross-sections therein for providing said predetermined operating positions.

17. An assembly as recited in claim 14 wherein said manually operated valve means is a ball valve comprising:

a housing having one aperture and another aperture;

a ball member rotatably disposed within said housing and having first, second, third and fourth fluid passages within said ball member wherein said second, third and fourth passages are each independently connected in fluid communication with said first passage, wherein said fluid passages are arranged and constructed so that when each one of said second, third and fourth fluid passages are individually in fluid communication with said one aperture, said first fluid passage is in fluid communication with said another aperture; wherein, said second fluid passage has a selected cross-sectional area for providing maximum flow through said valve;

said third fluid passage has a selected cross-sectional area less than the cross-sectional area of said second fluid passage;

said fourth fluid passage has a selected cross-sectional area less than the cross-sectional area of said third fluid passage;

said first fluid passage has a cross-sectional area at least as great as the cross-sectional area of said second fluid passage; and means connected to said ball member for selectively positioning said second, third, and fourth fluid passage in fluid communication with said one aperture.

18. A pressurized lubrication assembly for a center bearing of an exhaust-driven turbocharger associated with an internal combustion engine wherein said engine includes means for providing flow of pressurized lubricant through first conduit means to said turbocharger when said engine is running, said lubrication assembly comprising:

reservoir means for storing a quantity of lubricant under pressure;

second conduit means coupled to said reservoir means and said first conduit means for permitting flow of lubricant in a first direction from said first conduit means to said reservoir means and in a second direction from said reservoir means to said first conduit means and thereby to said turbocharger center bearing;

manually operated valve means disposed in said second conduit means, said valve means being constructed to have at least three manually actuated selective predetermined operating positions; wherein a first predetermined operating position substantially prevents lubricant flow in said second conduit means;

a second predetermined operating position permits maximum lubricant flow in said second conduit means; and a third predetermined operating position permits restricted fluid flow in said second conduit means.

19. An assembly as recited in claim 18 wherein said manually operated valve means has a fourth selective predetermined operating position permitting lubricant flow in said second conduit means wherein at a given pressure the restricted lubricant flow rate in said fourth selective position is greater than the restricted lubricant flow rate of said third selective position but less than the maximum lubricant flow rate of said second selective position.

20. An assembly as recited in claim 18 wherein said manually operated valve means comprises a ball valve having a rotatable ball-like member wherein said ball-like member has a plurality of fluid passages of different cross-sections therein for providing said predetermined operating positions.

21. An assembly as recited in claim 18 wherein said manually operated valve means is a ball valve comprising:

a housing having one aperture and another aperture;

a ball member disposed within said housing and having first, second, third and fourth fluid passages within said ball member wherein said second, third and fourth fluid passages are each independently connected in fluid communication with said first passage, wherein said fluid passages are arranged and constructed so that when each one of said second, third, and fourth fluid passages are individually in fluid communication with said one aperture said first fluid passage is in fluid communication with said another aperture; wherein, said second fluid passage has a cross-sectional area for providing maximum flow through said valve;

said third fluid passage has a cross-sectional area less than the cross-sectional area of said second fluid passage;

said fourth fluid passage has a cross-sectional area less than the cross-sectional area of said third fluid passage;

said first fluid passage has a cross-sectional area at least as great as the cross-sectional area of said second fluid passage; and means connected to said ball member for selectively positioning said second, third, and fourth fluid passages in fluid communication with said one aperture.

22. An improved prelubricator and pressurized lubricant reservoir assembly for lubricating machinery, such as an internal combustion engine, when the lubricant pressure in the machinery is below a specified level said assembly comprising:

reservoir means for storing a quantity of lubricant under pressure;

conduit means for coupling said reservoir means and said machinery in fluid communication whereby lubricant flows in said conduit means in a first direction from said machinery to said reservoir means and in a second direction from said reservoir means to said machinery;

valve means disposed in said conduit means for selectively permitting and preventing flow of lubricant in said conduit means; and flow restrictor means disposed in said conduit means intermediate said valve means and said reservoir means, said flow restrictor means having a first operating position for providing for restricted lubricant flow in said first direction and a second operating position for providing for substantially unrestricted lubricant flow in said second direction.

* * * * *